US011352982B2

(12) United States Patent
Marko et al.

(10) Patent No.: US 11,352,982 B2
(45) Date of Patent: Jun. 7, 2022

(54) FEED AND IGNITION DEVICE FOR A GAS ENGINE AND METHOD FOR OPERATING A FEED AND IGNITION DEVICE FOR A GAS ENGINE

(71) Applicant: Daimler AG, Stuttgart (DE)

(72) Inventors: Fabian Marko, Stuttgart (DE); Gerhard Koenig, Eschenbach (DE)

(73) Assignee: Daimler AG, Stuttgart (DE)

( * ) Notice: Subject to any disclaimer, the term of this patent is extended or adjusted under 35 U.S.C. 154(b) by 106 days.

(21) Appl. No.: 16/756,621

(22) PCT Filed: Sep. 21, 2018

(86) PCT No.: PCT/EP2018/075635
§ 371 (c)(1),
(2) Date: Apr. 16, 2020

(87) PCT Pub. No.: WO2019/076581
PCT Pub. Date: Apr. 25, 2019

(65) Prior Publication Data

US 2020/0256283 A1 Aug. 13, 2020

(30) Foreign Application Priority Data

Oct. 17, 2017 (DE) ..... 10 2017 009 607.4

(51) Int. Cl.
*F02M 21/04* (2006.01)
*F02B 19/10* (2006.01)
*F02D 19/02* (2006.01)

(52) U.S. Cl.
CPC ..... *F02M 21/04* (2013.01); *F02B 19/1019* (2013.01); *F02D 19/02* (2013.01)

(58) Field of Classification Search
CPC ..... F02M 21/04; F02M 21/0275; F02M 21/0248; F02B 19/1019; F02B 43/00;
(Continued)

(56) References Cited

U.S. PATENT DOCUMENTS 4,270,499 A 6/1981 Frelund
5,417,189 A * 5/1995 Regueiro ..... F02F 1/4214 123/262

(Continued)

FOREIGN PATENT DOCUMENTS

CN 1502008 A 6/2004
CN 101457687 A 6/2009

(Continued)

OTHER PUBLICATIONS

Chinese Office Action issued in Chinese application No. 201880067633.0 dated May 12, 2021, with partial English translation (Thirteen (13) pages).

(Continued)

*Primary Examiner* — Jacob M Amick
*Assistant Examiner* — Charles J Brauch
(74) *Attorney, Agent, or Firm* — Crowell & Moring LLP

(57) ABSTRACT

A feed and ignition device for a gas engine has an injector for the direct blowing-in of a combustion gas into a combustion chamber of the gas engine. The device also has a pre-combustion chamber into which a fuel can be introduced and a plurality of overflow openings distributed in the peripheral direction of the injector over the periphery of the feed and ignition device via which the pre-combustion chamber can be directly connected fluidically to the combustion chamber. A spark ignition device ignites a fuel-air mixture including at least the fuel introduced into the pre-combustion chamber. The pre-combustion chamber, the overflow openings, and the spark ignition device are formed by a first structural unit and the injector is formed by a second structural unit formed separately from the first structural unit.

16 Claims, 4 Drawing Sheets

(58) Field of Classification Search
CPC ..... F02B 19/1009; F02B 19/1004; F02B 19/1014; F02D 19/02; Y02T 10/12; Y02T 10/30
See application file for complete search history.

(56) References Cited

U.S. PATENT DOCUMENTS

| | | | | |
|---|---|---|---|---|
| 9,528,434 | B1 | 12/2016 | Thomassin et al. | |
| 2013/0306045 | A1 | 11/2013 | Blank | |
| 2014/0196686 | A1 | 7/2014 | Coldren et al. | |
| 2016/0024994 | A1* | 1/2016 | Engineer | F02B 19/12 123/256 |
| 2016/0245151 | A1* | 8/2016 | Yuuki | F02B 19/08 |
| 2016/0298529 | A1* | 10/2016 | Anders | F02B 23/0627 |

FOREIGN PATENT DOCUMENTS

| | | | |
|---|---|---|---|
| CN | 102900514 | A | 1/2013 |
| CN | 103925119 | A | 7/2014 |
| CN | 103998760 | A | 8/2014 |
| CN | 105275583 | A | 1/2016 |
| CN | 105275585 | A | 1/2016 |
| CN | 106014669 | A | 10/2016 |
| CN | 107035508 | A | 8/2017 |
| DE | 30 16 139 | A1 | 11/1980 |
| DE | 196 22 945 | A1 | 12/1997 |
| DE | 10 2005 005 851 | A1 | 8/2006 |
| EP | 0 237 971 | A1 | 9/1987 |
| EP | 0 643 209 | A1 | 3/1995 |
| EP | 1 476 926 | B1 | 11/2004 |
| EP | 1 936 143 | B1 | 6/2008 |
| EP | 3 043 049 | A1 | 7/2016 |
| JP | S53-165106 | U | 12/1978 |
| WO | WO 03/071644 | A1 | 8/2003 |
| WO | WO 2007/128101 | A1 | 11/2007 |
| WO | WO 2012/171119 | A1 | 12/2012 |

OTHER PUBLICATIONS

PCT/EP2018/075635, Interational Search Report dated Dec. 19, 2018 (Two (2) pages).
German Search Report issued in German application No. 10 2017 009 607.4 dated Jun. 15, 2018, with Statement of Relevancy (Nine (9) pages).

* cited by examiner

FEED AND IGNITION DEVICE FOR A GAS ENGINE AND METHOD FOR OPERATING A FEED AND IGNITION DEVICE FOR A GAS ENGINE

BACKGROUND AND SUMMARY OF THE INVENTION

The invention relates to a feed and ignition device for a gas engine and a method for operating a feed and ignition device for a gas engine.

Such a feed and ignition device for a gas engine, in particular for a motor vehicle, is already known from EP 3 043 049 A1, for example. The feed and ignition device has at least one injector, by means of which a combustion gas, i.e., a gaseous fuel, can be blown directly into a combustion chamber of the gas engine, which is designed as a cylinder, for example, to operate the gas engine. Furthermore, the feed and ignition device has a pre-combustion chamber into which a fuel can be introduced. The pre-combustion chamber is also referred to as pre-chamber and, when the gas engine is completely manufactured, for example, has a substantially smaller volume than the combustion chamber, which is also referred to as the main chamber or the main combustion chamber. The fuel which can be introduced into the pre-chamber, in particular directly, is for example a gaseous fuel or the fuel gas by means of which the gas engine can be operated.

Furthermore, the feed and ignition device has a plurality of overflow openings distributed in the peripheral direction of the injector across the periphery of the feed and ignition device, via which the pre-combustion chamber can be directly connected fluidically to the combustion chamber. In other words, when the gas engine is completely manufactured, the pre-combustion chamber is fluidically connected to the combustion chamber via the overflow openings. The overflow openings are also known as flare channels, through which, for example, ignition flares can pass from the pre-combustion chamber to the main combustion chamber (combustion chamber) in order to ignite the fuel gas, which is or was blown directly into the combustion chamber by means of the injector, by means of the ignition flares. At least one feed channel is provided, for example, which is different from the overflow openings and via which the aforementioned fuel can be introduced, in particular blown, into the pre-combustion chamber, in particular directly. The aforementioned fuel which can be or is introduced into the pre-combustion chamber does therefore not originate from the combustion chamber.

Furthermore, a spark ignition device is provided, by means of which a fuel-air mixture which comprises at least the fuel introduced, in particular via the feed channel, into the pre-combustion chamber, in particular directly, can be ignited and subsequently combusted. The aforementioned ignition flares result from the ignition of the fuel-air mixture, the ignition flares, for example, flowing out of the pre-combustion chamber via the overflow openings and into the combustion chamber (main combustion chamber) as a result of an increase in pressure in the pre-combustion chamber resulting from the ignition of the fuel-air mixture.

The object of the present invention is to develop a feed and ignition device of the aforementioned type in such a way that a particularly advantageous operation of the gas engine can be implemented.

In order to develop a feed and ignition device of the type specified herein in such a way that a particularly advantageous operation of the gas engine can be implemented, it is provided in accordance with the invention that the pre-combustion chamber, the overflow openings and the spark ignition device are formed by a first structural unit, wherein the injector is formed by a second structural unit formed separately from the first structural unit. In other words, the combustion chamber, the overflow openings and the spark ignition device are components of the first structural unit, wherein the injector is a component of the second structural unit. In particular, it is conceivable that the first structural unit also comprises at least one metering valve or several metering valves, by means of which, for example, the fuel can be introduced into the pre-combustion chamber or a quantity of the fuel to be introduced into the pre-combustion chamber can be adjusted.

The structural units are components, modules or assemblies which are designed, manufactured or assembled separately from one another and which can, for example, be manufactured or assembled independently or separately from one another, in particular pre-assembled, and arranged in a pre-assembled state, in particular connected to one another. Thus, the first structural unit forms the pre-combustion chamber, the overflow openings and the spark ignition device independently of the second structural unit, while the second structural unit forms the injector independently of the first unit. By way of example, the first structural unit is designed as a pre-chamber spark plug, which comprises or forms the pre-combustion chamber as a pre-chamber, the spark ignition device and the overflow openings, also referred to as flare channels, for example, independently of the second structural unit. By means of the spark ignition device, at least one ignition spark can be generated in the pre-chamber, by means of which the fuel-air mixture can be ignited and subsequently combusted. Furthermore, the pre-chamber spark plug can have the aforementioned metering valve or a metering device by means of which the fuel can be introduced into the pre-combustion chamber or an amount of the fuel to be introduced into the pre-combustion chamber can be adjusted.

Preferably, at least one additionally provided feed channel is provided, which is different from the overflow openings and from the combustion chamber designed as a cylinder, for example, and via which the fuel can be introduced into the pre-combustion chamber, in particular directly. The aforementioned fuel, which can be or is or has been introduced into the pre-combustion chamber via the feed channel, thus does not originate from the combustion chamber or does not flow from the combustion chamber via the overflow openings into the pre-combustion chamber, but is introduced into the pre-combustion chamber, in particular directly, via the at least one feed channel. In particular, the fuel can be the fuel gas, for example designed as gaseous fuel, by means of which the gas engine can be operated or a fired operation of the gas engine can be effected.

Due to the use of the feed and ignition device, it is possible to combust the fuel gas, in particular blown-in fuel gas or a fuel gas-air mixture comprising at least the fuel gas introduced into the combustion chamber via the injector, which is introduced directly into the combustion chamber, for example in the form of a cylinder, by means of diffusion combustion, by means of which diesel fuel for operating the diesel engine or a fuel-air mixture comprising the diesel fuel is also combusted in a diesel engine. Thus, with the help of the feed and ignition device according to the invention, a diesel-like combustion process can be implemented, whereby in particular a high power density and a high degree of efficiency can be implemented. In particular, it is possible, by means of the feed and ignition device according to the invention, to ignite the fuel gas which is directly introduced or blown into the combustion chamber by means of the injector under conditions under which the fuel gas or the fuel gas-air mixture cannot ignite itself. To ignite the fuel gas-air mixture, the fuel-air mixture is ignited in the pre-combustion chamber, resulting in ignition flares. Due to an increase in pressure in the pre-combustion chamber resulting from the ignition of the fuel-air mixture, the ignition flares flow from the pre-combustion chamber via the overflow openings into the combustion chamber, such that the fuel gas or the fuel gas-air mixture is ignited by means of the ignition flares in the combustion chamber and is at least substantially combusted as in the case of diffusion combustion occurring in a diesel engine. Thus, the feed and ignition device according to the invention enables the ignition of fuels which are not self-igniting under engine-relevant operating conditions, which are introduced directly, in particular by means of the injector, and in particular injected, such as, for example, gaseous fuels or liquid fuels, in particular natural gas, for implementing a diesel-like diffusion combustion in the combustion chamber. This allows a high power density and a high thermal efficiency of the gas engine to be implemented. The feed and ignition device according to the invention uses the pre-combustion chamber as a pre-chamber for the ignition of the non-self-igniting fuel gas blown directly into the combustion chamber, which is introduced or blown directly into the combustion chamber, in particular by means of the injector designed as a high-pressure injector, for example, with the formation of high-pressure fuel gas jets. In principle, the feed and ignition device according to the invention could also be used for internal combustion engines which can be operated with a liquid fuel, such that instead of the fuel gas, for example, a liquid fuel can be used which can be introduced directly into the combustion chamber by means of the injector.

The aforementioned fuel is fed into the pre-combustion chamber, for example, via a metering valve. The fuel introduced into the pre-combustion chamber, in particular directly, can mix in the pre-combustion chamber, for example, with air or air+inert gas, which enters or flows into the pre-combustion chamber from the combustion chamber via the overflow openings, to form a homogenous ignitable mixture. This homogenous ignitable mixture is, for example, the aforementioned fuel-air mixture and is ignited in the pre-combustion chamber by means of the spark ignition device acting as a spark ignition source, such that the fuel-air mixture is not ignited by self-ignition. The ignition of the fuel-air mixture in the pre-combustion chamber by means of the spark ignition device results in at least one flame, which passes from the pre-combustion chamber into the combustion chamber (main combustion chamber) in the form of flare jets or in the form of the aforementioned ignition flares through the overflow openings acting as overflow channels. The flare jets ignite the fuel gas injected into the combustion chamber at high pressure by means of the injector and thus a quantity of combustion chamber fuel gas blown directly into the combustion chamber at high pressure by means of the injector, resulting in a diesel-like diffusion combustion in the combustion chamber.

In order to further develop a method for operating a feed and ignition device of the type specified herein in such a way that a particularly advantageous operation of the gas engine according to the invention can be implemented, it is provided in accordance with the invention that a fuel-air mixture present in the pre-combustion chamber is ignited by means of the spark ignition device and the ignited fuel-air mixture penetrates into the combustion chamber as flare jets via the overflow openings and a combustion chamber fuel gas quantity is blown into the combustion chamber as high-pressure fuel gas jets by means of the injector, and the high-pressure fuel gas jets are ignited by the flare jets. The high-pressure fuel gas jets ignite on the flare jets emerging from the pre-chamber into the main combustion chamber. In principle, the process described can be spoken of as a two-stage ignition, since first the fuel-air mixture is ignited in the pre-chamber and then the flare jets emerging from the pre-chamber ignite the high-pressure fuel gas jets.

In a further embodiment of the method according to the invention, the combustion chamber fuel gas quantity is divided into a pilot fuel gas quantity and a main fuel gas quantity. The pilot fuel gas quantity is blown into the combustion chamber by means of the injector and the pilot fuel gas quantity is ignited by the flare jets. The subsequently blown-in main fuel gas quantity is ignited by the ignited pilot fuel gas quantity. In such a divided introduction, as in two-stage ignition, the fuel-air mixture in the pre-chamber is ignited first. The subsequent flare jets emerging from the pre-chamber ignite the pilot fuel gas quantity and the ignited pilot fuel gas quantity finally ignites the main fuel gas quantity. The ignited pilot fuel gas quantity results in enlarged flame zones for a safe ignition of the remaining main fuel gas quantity, such that an at least three-stage ignition can be implemented.

This makes it possible to operate an internal combustion engine with gaseous or liquid fuel using a diesel-like process with high efficiency and high power density. By way of example, when natural gas is used as the fuel gas, $CO_2$ emissions can be significantly reduced by more than 20 percent compared to diesel engines. Compared to diesel pilot ignition, the following advantages arise: no second fuel is required; cost and installation space savings by dispensing with a second fuel system, which usually has a pump, a tank and other components; a simpler injector, since no separate dosage of two fuels is required; when using a gaseous fuel, liquid fuel can be avoided in the injector, whereby a coking tendency is reduced. The feed and ignition device thus has a dual function. On the one hand, the feed and ignition device is used to blow the fuel gas directly into the combustion chamber. In addition, the feed and ignition device is used, for example, to ignite and combust the fuel gas blown into the combustion chamber by means of the fuel-rinsed, spark-ignited pre-chamber, forming high-pressure fuel gas jets and thereby causing a diesel-like diffusion combustion of the fuel gas-air mixture in the combustion chamber.

Further advantages, features and details of the invention emerge from the following description of preferred exemplary embodiments and by means of the drawings. The features and combinations of features mentioned above in the description as well as the features and combinations of features mentioned in the following Figure description and/or shown in the Figures alone can be used not only in the combination indicated in each case, but also in other combinations or on their own, without leaving the scope of the invention.

DETAILED DESCRIPTION OF THE DRAWINGS

Figure 1:
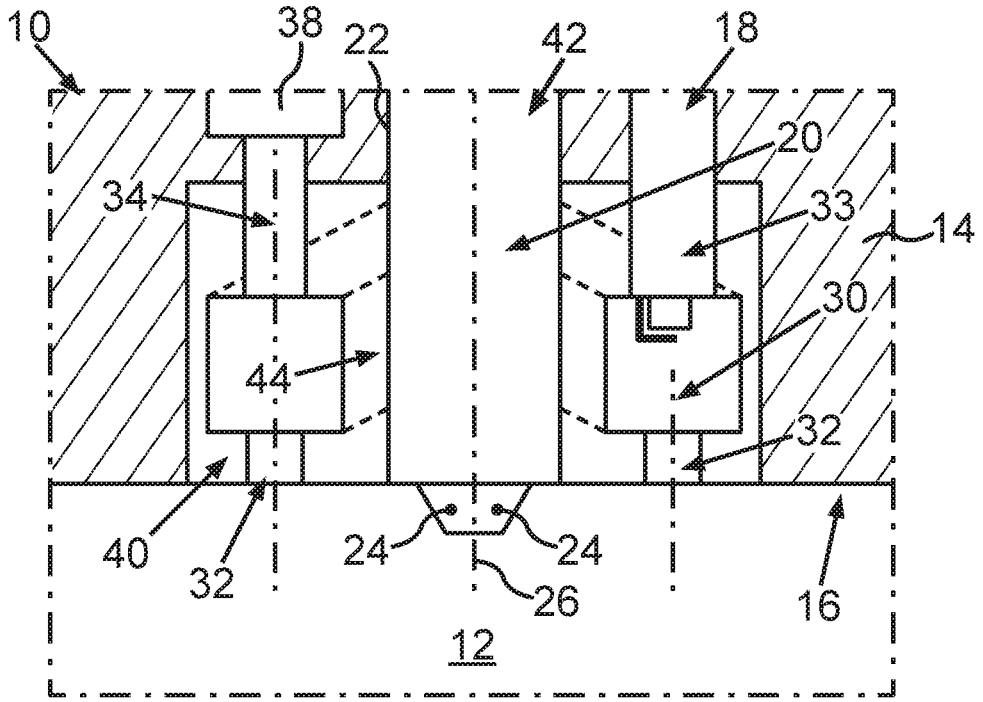
FIG. 1 shows sectionally, a schematic sectional view of a gas engine, having a feed and ignition device in accordance with the invention according to a first embodiment.

In the Figures, identical or functionally identical elements are provided with identical reference numerals.

Figure 5:
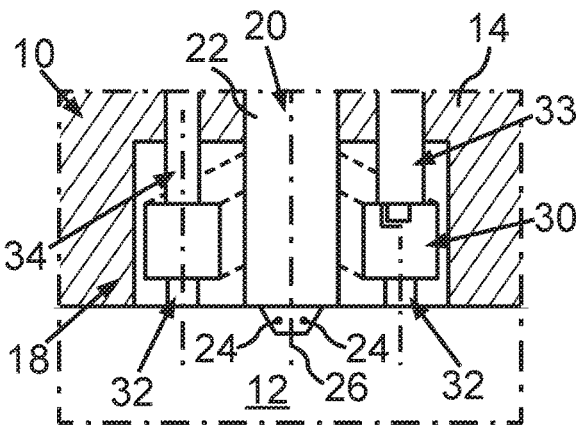
FIG. 5 shows sectionally, a schematic sectional view of the feed and ignition device according to the first embodiment.

In a schematic sectional view, FIG. 1 sectionally shows an internal combustion engine, designed as a gas engine 10, of an automobile, which is designed as a motor vehicle, in particular as a commercial vehicle or heavy goods vehicle or off-highway-application, and can be driven by means of the gas engine 10. The gas engine 10 has at least one combustion chamber 12 which is designed, for example, as a cylinder and is also referred to as the main chamber, main combustion chamber or main combustion space, and is formed, for example, by a cylinder housing of the gas engine 10 which is not recognizable in FIG. 1. The gas engine 10 in its completely manufactured condition has the cylinder housing and a cylinder head 14, which can be seen sectionally in FIG. 1, which is manufactured independently or separately from the cylinder housing and is connected to the cylinder housing. By way of example, the cylinder head 14 forms a combustion chamber roof 16 of the combustion chamber 12. The gas engine 10 further comprises in its completely manufactured state a feed and ignition device designated 18 in its entirety, which is assigned to the combustion chamber 12. FIGS. 1 and 5 show a first embodiment of the feed and ignition device 18.

The feed and ignition device 18 has at least one injector 20, by means of which a fuel gas can be injected directly into the combustion chamber 12. For this purpose, the injector 20 has, for example, a housing 22 and an injector needle which is accommodated in the housing 22 and can be moved translationally relative to the housing 22 and which is not recognizable in FIG. 1. Furthermore, the injector 20 has a plurality of injection openings 24 arranged in succession in the peripheral direction of the injector 20, through which the fuel gas, which is first introduced into the housing 22, can flow out of the housing 22 and thus out of the injector 20 and subsequently flow directly into the combustion chamber 12, whereby the fuel gas can be blown directly into the combustion chamber 12. The injector needle can be moved in translation relative to the housing 22 between at least one open position and at least one closed position, in particular along an axis 26 around which the injection openings 24 are arranged, in particular uniformly distributed. The injector 20 is designed as a high-pressure injector (HP injector), such that the fuel gas is blown directly into the combustion chamber 12, forming high-pressure fuel gas jets 28 which can be seen in FIG. 2. This means that, by means of the injection openings 24, the high pressure fuel gas jets 28 are formed from the fuel gas as it flows through the injection openings 24.

In this case, the injector needle closes the injection openings 24 in the closed position such that the fuel gas cannot flow through the injection openings 24 and thus cannot escape from the injector 20. In the open position, however, the injector needle releases the injection openings 24 such that the fuel gas is blown directly into combustion chamber 12. The feed and ignition device 18 also has a pre-combustion chamber 30, which is also referred to as the pre-chamber. As will be explained in more detail below, a fuel can be introduced into the pre-combustion chamber 30. The fuel which can be introduced into the pre-combustion chamber is preferably the fuel gas which is used to operate the gas engine 10. In addition, the feed and ignition device 18 has a plurality of overflow openings 32, which are arranged in the peripheral direction of the injector 20 and distributed, in particular evenly, over its periphery and via which the pre-combustion chamber 30 can be fluidically connected or is connected to the combustion chamber 12. In addition, a spark ignition device 33, designed for example as a spark plug, is provided, by means of which a fuel-air mixture, which comprises at least the fuel introduced into the pre-combustion chamber 30, can be ignited.

Figure 11:
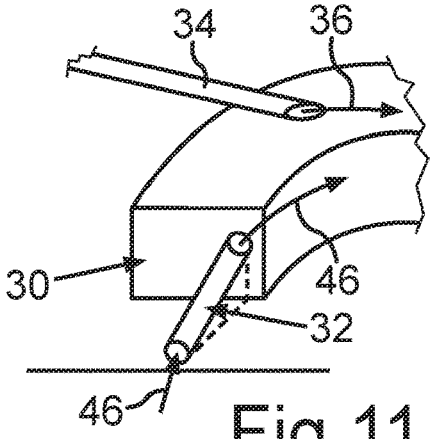
FIG. 11 shows sectionally, a schematic and sectional perspective view of the feed and ignition device according to an eighth embodiment.

In conjunction with FIG. 11, it can be recognized that the feed and ignition device 18 has at least one additionally provided teed channel 34, different from the combustion chamber 12 and from the overflow openings 32, via which the fuel (fuel gas) is introduced, in particular blown, directly into the pre-combustion chamber 30. In FIG. 11, an arrow 36 illustrates the fuel, which is directly introduced, in particular blown, into the pre-combustion chamber 30 by means of the feed channel 34. The feed channel 34, which can also be seen in FIG. 1, is designed as a capillary, for example. Furthermore, the feed and ignition device 18 comprises at least one valve element 38, which is also referred to as metering valve or fuel metering valve. By means of the valve element 38, a quantity of the fuel which can be directly blown or introduced into the pre-combustion chamber 30 via the feed channel 34 can be set such that, for example, the fuel is fed from a reservoir for receiving and at least temporarily storing the fuel via the valve element 38 into the feed channel 34 and is directly introduced, in particular blown, into the pre-combustion chamber 30 via the feed channel 34. The reservoir is, for example, a tank, from which the injector 20 is also supplied with the fuel gas, which is blown directly into the combustion chamber 12 by means of the injector, forming the high-pressure fuel gas jets 28.

In order to implement a particularly advantageous operation of the gas engine 10, the pre-combustion chamber 30, the overflow openings 32 and the spark ignition device 33 are formed by a first structural unit 40. In particular, it is conceivable that the first structural unit 40 also comprises at least one metering unit or metering device by means of which, for example, the fuel can be introduced into the pre-combustion chamber or a quantity of the fuel to be introduced into the pre-combustion chamber can be adjusted.

Here, the first structural unit 40 is designed, for example, as a pre-chamber spark plug which comprises the spark ignition device 33, the pre-combustion chamber 30 and the overflow openings 32, which are also referred to as overflow channels, overflow bores or flare channels. The injector 20 is thereby formed by a second structural unit 42 or designed as such a second structural unit 42, wherein the second structural unit 42 is designed separately from the first structural unit 40. In other words, the structural units 40 and 42 are separately or independently mountable or producible assemblies or modules which are mounted independently or separately from each other, in particular pre-mounted, and in the pre-mounted state are arranged on each other, in particular connected to each other. The first structural unit 40, for example, has an opening designed as a through-opening, into or through which at least a length section of the second unit 42 is inserted or pushed. From FIG. 1, it is particularly easy to see that the pre-combustion chamber 30 is designed as a completely closed annular chamber rotating in the peripheral direction of the injector 20, which surrounds at least one length area 44 of the injector 20 completely peripherally in the peripheral direction of the latter.

Since the fuel is introduced into the pre-combustion chamber 30, and since the fuel-air mixture is ignited in the pre-combustion chamber 30, the pre-combustion chamber 30 is a rinsed and spark-ignited pre-combustion chamber by means of which, as a result of the ignition of the fuel-air mixture, a diesel-like diffusion combustion of the fuel gas injected directly into the combustion chamber 12 can be effected. Due to the ignition of the fuel-air mixture in the pre-combustion chamber 30, ignition flares emerge, which are also referred to as flare jets or flame jets. Due to an increase in pressure in the pre-combustion chamber 30 resulting from the ignition of the fuel-air mixture in the pre-combustion chamber 30, the flare jets flow out of the pre-combustion chamber 30 via the overflow openings 32 and into the combustion chamber 12, such that the fuel gas injected into the combustion chamber 12 by means of the injector 20 is ignited with the aid of the flare jets and is subsequently burned in a diesel-like diffusion combustion. For this purpose, such a design of the pre-combustion chamber 30 is advantageous such that a high jet impulse, in particular of the flare jets, only a low heat dissipation into the walls and a best possible energy conversion in the flame jets coming out of the pre-combustion chamber 30 can be implemented.

In addition, for example, an exhaust gas recirculation system is provided, whereby exhaust gas from an exhaust tract of the gas engine 10 is recirculated into an intake tract of the gas engine 10. Air is also fed to the combustion chamber 12 as combustion air, wherein the air can flow through the intake tract and is fed into combustion chamber 12 by means of the intake tract. This creates a fuel gas-air mixture in the combustion chamber 12, which comprises the air supplied to the combustion chamber 12 and the fuel gas injected directly into the combustion chamber 12. The fuel gas-air mixture is ignited by means of the flare jets. This results in an exhaust gas from the gas engine 10, wherein the exhaust gas is discharged from the combustion chamber 12 by means of the exhaust tract. The exhaust gas can then flow through the exhaust tract. For exhaust gas recirculation, an exhaust gas recirculation device is provided, which comprises at least one exhaust gas recirculation line. The exhaust gas recirculation line is connected on the one hand fluidically with the exhaust tract and on the other hand fluidically with the intake tract, such that at least a part of the exhaust gas flowing through the exhaust tract can be branched off from the exhaust tract and can be recirculated to or into the intake tract. The recirculated exhaust gas is taken along by the air flowing through the intake tract and transported into the combustion chamber 12. In the combustion chamber 12, the recirculated exhaust gas can act as an inert gas during diffusion combustion. The exhaust gas recirculation system is used to implement external exhaust gas recirculation. Alternatively or additionally, an internal exhaust gas recirculation is conceivable, in which, for example, by means of a piston accommodated in the combustion chamber 12 in a translationally moveable manner, at least a part of the exhaust gas is sucked back into the combustion chamber 12 from at least one outlet channel assigned to the combustion chamber 12. Such an exhaust gas recirculation can, for example, keep nitrogen oxide emissions particularly low.

Furthermore, a favorable volume-surface ratio of the pre-combustion chamber 30 can be implemented by forming the pre-combustion chamber 30 from only one space or volume element. Furthermore, a particularly short length of the overflow openings 32, which are designed as overflow bores, for example, is preferably provided.

In the pre-chamber, which is preferably designed as an annular channel or annular space, preferably exactly one ignition source is provided. Preferably, however, several ignition sources are provided in order to implement a particularly uniform discharge of the flare jets. Preferably, the above-mentioned parts, such as the pre-combustion chamber 30, overflow openings 32 and ignition source or spark ignition device 33, are individually exchangeable and thus designed as separate and independent components. Preferably, the pre-combustion chamber 30 comprises only the aforementioned annular space and the overflow openings and has an advantageous surface-to-volume ratio such that a high flare jet pulse can be implemented.

It has also proved to be particularly advantageous when the feed and ignition device 18 is designed to effect a swirling flow in the pre-combustion chamber 30. This can be recognized, for example, in FIG. 11. In FIG. 11, arrows 46 illustrate an inflow of air from the combustion chamber 12 into the pre-combustion chamber 30 via the overflow openings 32. In other words, for example, when the piston moves from its bottom dead center to its top dead center, air is conveyed by the piston through the overflow openings 32 into the pre-combustion chamber 30. Furthermore, since the fuel is fed into the pre-combustion chamber 30 via the feed channel 34, the fuel in the pre-combustion chamber 30 can mix with the air flowing into the pre-combustion chamber 30, such that it results in the aforementioned fuel-air mixture. As can be seen from the arrows 36 and 46, the air flowing into the pre-combustion chamber 30 and the fuel introduced into the pre-combustion chamber 30 flow through the pre-combustion chamber 30 in an at least substantially swirling manner, such that, for example, an at least substantially swirling flow of the fuel-air mixture is created in the pre-combustion chamber 30. Thus, a swirl can be generated in the pre-combustion chamber 30. Preferably at least two or more ignition sources are provided, for example, to ignite the fuel-air mixture in the pre-combustion chamber 30. It is also conceivable, for example, to integrate the pre-combustion chamber into the cylinder head 14, such that an optimum connection to cooling channels can be implemented. In this way, an advantageous heat dissipation can be implemented.

It has also proved to be particularly advantageous when at least one heating element, in particular an electric heating element, is provided for heating the pre-combustion chamber 30. The heating element can be arranged at the pre-combustion chamber 30 and is particularly advantageous for mobile operation, in which it can result in a cold start, warm-up, idling etc. of the gas engine 10.

The diffusion combustion with self-ignition is a diesel-engine combustion which, compared with spark ignited, pre-mixed combustion, which is used for example in a petrol engine and is therefore also referred to as petrol engine combustion, offers the advantage of high thermal efficiency through the use of a high compression ratio and the possibility of using very high air dilutions or inert gas dilutions in the main combustion chamber. The previous and following statements about the gas engine 10, which can be operated with the fuel gas and thus with a gaseous fuel, can also be readily applied to internal combustion engines which are operated with a liquid fuel. In particular, by means of the feed and ignition device 18, a method can be implemented which can be used to ignite fuels, in particular fuel gases or fuel- or fuel gas-air mixtures whose self-ignition tendency is not sufficient to ignite spontaneously at the temperatures and pressures prevailing during high-pressure blowing-in or high-pressure injection and to initiate a subsequent diffusion combustion. The process or the combustion of the fuel gas-air mixture in combustion chamber 12, which can be effected by means of the feed and ignition device 18, represents a combination of spark ignition and subsequent diesel engine combustion. The following operating modes and gas engines are known to be prior art:

a) petrol-engine-operated gas engines having a stoichiometric fuel gas-air ratio and leanly operated, i.e., operated with excess air, gas engines: in such a process, a combustible gas-air mixture is either pre-mixed and fed into the combustion chamber or generated during a compression phase in the combustion chamber by direct introduction of the fuel gas. The combustion is then initiated by spark ignition. When using the stoichiometric combustion process, a simple exhaust gas purification system can be used with the aid of a three-way catalytic converter. By operating with inert gas in the combustion chamber, especially when using an external, cooled exhaust gas recirculation system, temperatures can be lowered and efficiency increased with this combustion process. Leanly operated gas engines are nowadays mainly used as stationary engines for power generation. Due to a high air surplus of $\lambda>1.6$ and thus low combustion temperatures and heat losses, they achieve very good thermal efficiencies. A disadvantage compared to stoichiometric operation with inert gas admixture, however, is the complex exhaust gas aftertreatment to keep nitrogen oxide emissions (NOx emissions) low.

A challenge in the case of high dilution rates is above all the stable ignition of the pre-mixed mixture in the combustion chamber, which is designed as a cylinder, for example. Various ignition methods can be used for this. In addition to any conventional electrical ignition system, pre-chamber systems or, as a further option, ignition by means of diesel pilot injection are also suitable. Pre-chamber spark plugs are prior art in the case of petrol-operated stationary gas engines. They can be either passive, i.e., un-rinsed, as is provided in EP 1 476 926 A1, for example, the mixture composition in the pre-chamber corresponds to that of the main combustion chamber, or they can be operated rinsed with fuel, as is provided in DE 10 2005 005 851 A1, for example. In non-rinsed operation, previously mixed fuel gas-air-inert gas mixture from the main combustion chamber enters the pre-chamber. There is a spark ignition in the pre-chamber and then a discharge of flare jets from the overflow channels into the main combustion chamber. An already pre-mixed fuel-air mixture is present in the main combustion chamber, which ignites by means of the flare jets and combusts with a deflagrative flame propagation according to the petrol engine process. If the pre-chamber is rinsed with fuel, the excess air in the pre-chamber can be reduced in lean gas engines, i.e., those operated with excess air in the main combustion chamber, and an at least almost stoichiometric mixture can be produced in the pre-chamber, Two material flows enter the pre-chamber: fuel gas-air-inert gas from the main combustion chamber and as an additional substance flow fuel through the metering valve. Due to the optimized fuel-air ratio, it results in a better ignition of the pre-chamber and, as a result, a faster ignition of the mixture in the main combustion chamber. In this way, high fuel-air ratios of $\lambda>2$ can be driven stably by the engine, resulting in high efficiency and significantly lower raw nitrogen oxide emissions.

two-fuel gas engines, which are also referred to as dual-fuel: gas engines are referred to as two-fuel gas engines (dual-fuel engines) which can be operated with both diesel fuel and fuel gas. The proportion of gaseous fuel can vary between 0 percent and 95 percent inclusive by mass. The gaseous fuel is fed into the combustion chamber either in the intake manifold or by low-pressure direct injection, and by mixing with air, an ignitable mixture that is as homogenous as possible is produced. The ignition of this pre-mixed fuel gas-air mixture occurs due to the use of a diesel HD direct injection. The fuel injected in this way ignites itself and subsequently ignites the pre-mixed mixture in the combustion chamber. The maximum admixture of natural gas at full load is limited by engine knocking, since the compression ratio is lower than that of a diesel engine, but due to the temperatures and pressures required for self-ignition of the diesel fuel, it does not reach the low values actually required for optimum petrol-engine operation.

c) diesel-like operated gas engines: in contrast to petrol-engine operated lean gas engines or gas engines having $\lambda=1$ and EGR (exhaust gas recirculation), whose compression ratio is in the range of $\varepsilon=11\text{-}14$, a compression ratio of $\varepsilon=15\text{-}20$ can be used for diesel-like diffusion combustion. In this case, gaseous fuel is blown under high pressure directly into the combustion chamber via a multi-hole nozzle. The thermal efficiency of the internal combustion engine can thus be increased to over 40 percent.

Prior art in commercial vehicles is currently the high-pressure direct-injecting diesel engine. In the commercial vehicle sector, the gas engine still represents a supplement to the already existing diesel engine platforms. Therefore, the object is to use as many common parts as possible for the diesel engine. With diesel engine gas combustion, more common parts can be used for the diesel engine. In addition, design advantages such as peak pressure resistance can be exploited. Disadvantages of the diesel engine base for a petrol engine application, such as a low thermal stability of the cylinder head and manifold, do not occur during the gas injection process, such that an almost identical power density can be achieved in comparison to the diesel fuel-operated engine.

Problematic in the case of diesel-like gas- or diffusion combustion is the generation of high-pressure fuel gas jets 28, which are also referred to as HD-DI gas jets, which do not ignite spontaneously due to their cetane number of $CZ<40$, which is low compared to diesel fuel. For this reason, various methods are described which serve to ignite the gas jets. A known method for the ignition of the HD gas direct injection jets is the pilot injection of spontaneously ignitable fuel, wherein it is mostly diesel fuel, in particular with a mass fraction of the total fuel quantity of ≤10 percent, either by two separate injectors as in EP 6 432 09 A1 or EP 2 370 71 A1, for example, or also by a needle-needle injector as in WO 2012/17119 A1, for example. At these pilot zones, which are self-igniting in the main combustion chamber, the gas fuel subsequently ignites, followed by diesel-like diffusion combustion. A non-commercially applied method for the ignition of high-pressure gas direct injection jets is ignition by means of a glow plug, as described, for example, in WO 2007/128101. In this process, the HD gas direct injection jets are ignited on a hot surface, in particular a glow plug.

The present method is based on the functional principle of a diesel engine combustion. It is based on high-pressure direct blowing-in or injecting of fuel gas or fuel gas into the combustion chamber 12 with a high compression ratio of, for example, $\varepsilon>12$. The fuel gas does not ignite itself under engine-relevant operating conditions. The method is characterised, in particular, by the fact that, for the ignition of the high-pressure gas jets, a pre-chamber with the possibility of introducing fuel is used, as already described in DE 10 2005 005 851 A1, for example. This contains a pre-chamber volume which is connected to the main combustion chamber by several overflow channels, as well as a spark ignition device 33. The pre-chamber volume Vvk is thus smaller than the compression volume of the main combustion chamber, wherein, for example, the following applies:

$$Vvk<10\text{ percent}*V\text{Haupt,komp}$$

VHaupt,komp denotes the compression volume of the combustion chamber 12.

Figure 2:
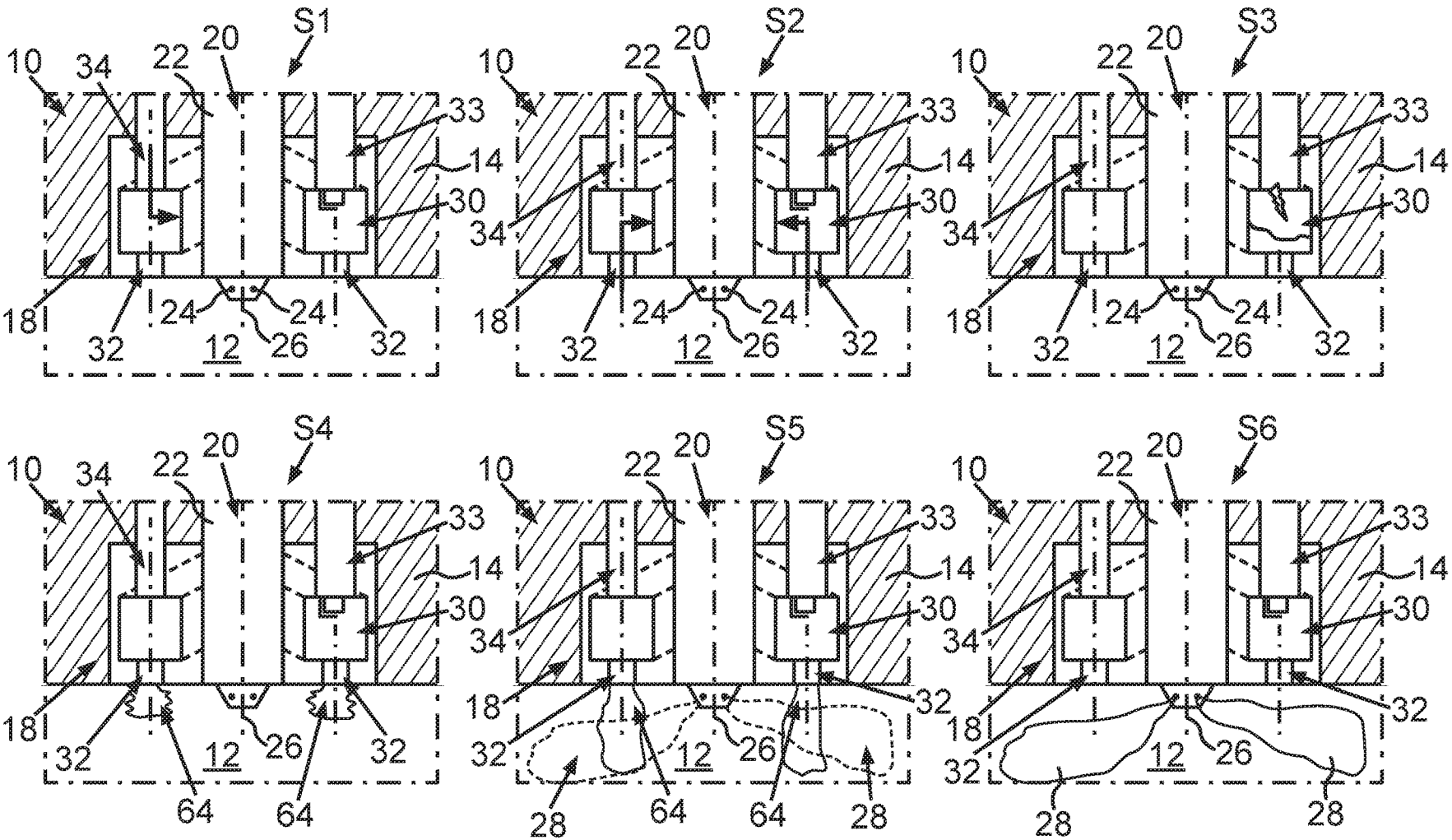
FIG. 2 shows sectionally in each case, schematic sectional views of the gas engine to illustrate a functional principle of the feed and ignition device.
Figure 3:
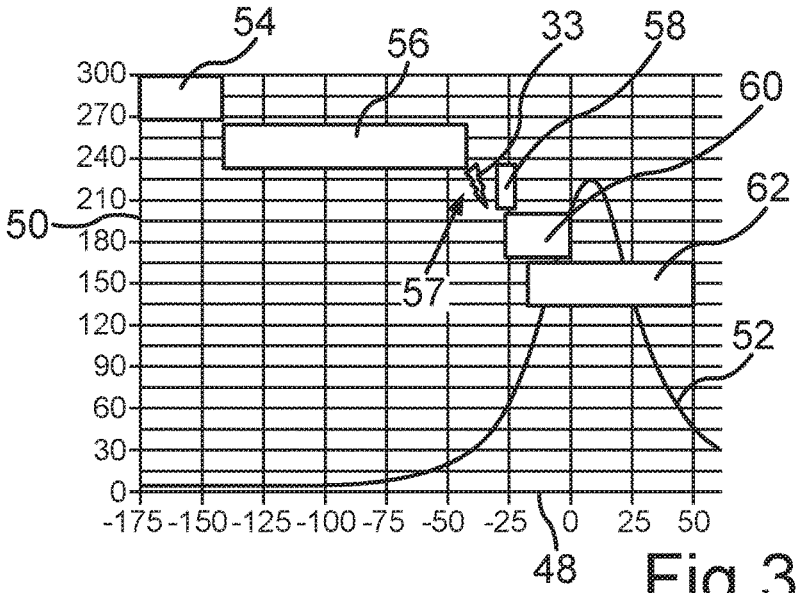
FIG. 3 is a diagram to illustrate the functional principle.

The method can be seen, in particular, from FIG. 2, such that the functional operation of the gas engine 10 is described using FIG. 2. Furthermore, FIG. 3 shows a diagram with 48 degrees crank angle on its abscissa. Furthermore, a pressure prevailing in the combustion chamber 12 is plotted on the ordinate 50, such that a curve 52 entered in the diagram shown in FIG. 3 shows a curve of the pressure prevailing in the combustion chamber 12 over degrees crank angle. Different phases 54, 56, 57, 58, 60 and 62 of the method are entered in FIG. 3. Thus, FIG. 3 shows an example of a chronological sequence of phases 54, 56, 57, 58, 60, 62 over degrees crank angle (° KW), wherein the curve 52 is representative cylinder pressure curve. As a spark ignition source, the spark ignition device 33 is depicted particularly schematically in FIG. 3. In phase 54, for example, the fuel is fed into the pre-combustion chamber 30 in a pre-chamber fuel quantity at a low pressure of >5 bar. In phase 56, air from the main combustion chamber is introduced into the pre-combustion chamber 30. In phase 57, the fuel-air mixture is ignited in the pre-combustion chamber 30. In phase 58, the flame jets exit the pre-combustion chamber 30 via the overflow openings 32 and enter the main combustion chamber. In phase 60, the fuel gas is injected directly into the combustion chamber 12 under high pressure in a combustion chamber fuel gas quantity using the injector 20. Finally, in phase 62, the diffusion combustion of the fuel gas-air mixture takes place in the combustion chamber 12.

The pre-chamber used is characterised in particular by the fact that the fuel can be introduced into the pre-chamber through at least one or more capillaries and/or directly by means of at least one gas injection valve or by means of several gas injection valves, also referred to as metering valves, in a defined pre-chamber fuel quantity. The respective gas injection valve for bringing in, in particular introducing, the fuel into the pre-combustion chamber 30 is designed, for example, as a low-pressure gas injection valve or as a high-pressure gas injection valve. The pre-combustion chamber fuel quantity introduced into the pre-combustion chamber 30 is significantly lower than the combustion chamber fuel gas quantity introduced into the main chamber by the high-pressure direct injection.

All fuels that are not self-igniting in the diesel engine process at the pressures and temperatures relevant to the engine are suitable as fuel gases for the method. In the technical application, these are mainly gaseous fuels such as NG (Natural Gas) or LPG (liquified petroleum gas). In addition, propane, ethane, butane, methane, hydrogen can be considered as individual substances or as a gas mixture. The same fuel gases are preferably used for high-pressure direct injection into the combustion chamber 12 and the injection into the pre-chamber, in principle, the use of two different fuels is also possible.

In the main combustion chamber, a mixture of air-inert gas or exclusively air is present before the high-pressure direct injection. There is no pre-mixed or partially mixed fuel gas/air mixture in the main combustion chamber before the high-pressure direct injection. The fuel introduced into the pre-chamber mixes in the pre-chamber with the air/air-inert gas mixture entering the pre-chamber through the overflow channels when the pressure in the main combustion chamber is increased by the compression stroke of the piston. At the ignition point in the pre-chamber, a homogenously mixed and ignitable fuel-air mixture close to the stoichiometric air ratio is aimed for, wherein a fuel-air ratio of $\lambda=1$ is preferably provided. The mixing ratio is determined by the amount of pre-chamber fuel introduced into the pre-chamber and the end of blowing-in, which is limited by the maximum pressure of the blowing-in or injecting in the direction of the top dead center. For an estimation of the end of blowing-in, it is assumed that the pre-chamber is completely filled with fuel at the end of blowing-in and that air from the main combustion chamber then enters the pre-chamber without rinsing losses. For a volumetric air requirement of methane of Lst,vol=10, the end of the blowing-in should be positioned so that the pre-chamber is completely filled with gas at one tenth of the pressure at the ignition point. As a calculation example, at high load, pressures of 50 to 70 bar are reached at ignition point (ZZP), such that, at a pressure of 5 to 7 bar, fuel can still be blown into the pre-chamber. Technically sensible pressure ranges for the injection into the pre-chamber are thus pressure ranges from 5 to 200 bar inclusive, in principle higher pressures are also possible. The advantage of a higher blowing-in or injection pressure is that the blowing-in end can be flexibly positioned close to the ignition point in the compression pressure increase in the main combustion chamber and/or a late blowing-in is possible. In addition, a higher impulse of the fuel flowing in enables a better mixing in the pre-chamber.

The ignition in the pre-chamber takes place by means of a spark ignition device, such as a conventional coil ignition system having a hook spark plug or also by means of new types of alternative ignition systems such as corona or laser ignition. One or several spark ignition devices can be used. Due to the use of a high compression ratio in contrast to the gasoline engine and ignition near the top dead center in the pre-chamber, the pressure and the temperature at the ignition point in the pre-chamber are very high. This results in a high density in the pre-chamber at the ignition point and an advantageously high, in particular laminar, combustion velocity. In contrast to known diesel pre-chambers used on executed combustion chambers, as, for example, in DE 301 613 9 A1, there is no self-ignition in the pre-chamber. Since an ignitable mixture is only present when air enters the pre-chamber through the overflow channels after the end of fuel injection into the pre-chamber shortly before the ignition point, an undesirable self-ignition, for example due to locally high component temperatures, is prevented in the pre-chamber.

After spark ignition in the pre-chamber, deflagrative or pre-mixed flame propagation occurs, resulting in a strong temperature increase in the pre-chamber. From the resulting increase in volume and pressure, a flame in the form of the aforementioned flare jets passes through the overflow channels into the main combustion chamber. Shortly before and/or parallel to and/or after the flare jets start to emerge from the overflow openings 32, which are designed as overflow bores, for example, the high-pressure direct blowing-in or injecting of the combustion chamber fuel gas quantity into the main combustion chamber takes place. The overflow bores are arranged in such a way that there is a geometric overlap of flare jets with high-pressure direct injection jets. Possible pressure ranges for high-pressure direct gas injection are, for example, pressure ranges from 100 bar up to 600 bar inclusive.

The HP blowing-in or injecting jets are ignited by the flare jets emerging from the pre-chamber into the main combustion chamber. In principle, the method described can be spoken of as a two-stage ignition. Due to the fuel properties, there is no self-ignition of the combustion chamber fuel gas quantity in contrast to the classic diesel engine. The high-pressure direct injection or combustion chamber fuel gas quantity can also be divided into a pilot or main fuel gas quantity. The blowing-in or injecting of the main fuel gas quantity can also take place in several proportions. The pilot fuel gas quantity mpilot,Di is significantly smaller than the main fuel gas quantity mmain,DI. The pilot fuel gas quantity introduced first is ignited by the pre-chamber flare jets. The main fuel gas quantity blown in subsequently ignites at the combustion zones resulting from the pre-chamber flare jets and the pilot fuel gas quantity. In principle, a three-stage ignition takes place here.

The combustion of the main combustion gas volume is subsequently carried out analogously to a classic diesel engine in the form of a diffusion combustion of the combustion chamber fuel gas volume introduced by high pressure direct injection. This diesel-like diffusion combustion represents the main heat release of the combustion engine and ensures a high thermal efficiency. In contrast to the known operation of petrol gas engines with a pre-chamber and deflagrative main combustion, the main heat release in the described method is achieved by a diesel-like diffusion combustion. In addition, the substance flow entering the pre-chamber differs from the main combustion chamber. Since in the described method, the combustion chamber fuel gas quantity with HD direct injection is only introduced into the combustion chamber near the top dead center, there is no premixed fuel gas-air mixture in the main combustion chamber. Only air or air and inert gas enters the pre-chamber from the main combustion chamber.

Here, relevant components are: the pre-chamber, the spark ignition device 33, the metering valve, the at least one feed channel 34, the overflow openings 32 and the injector 20, which is designed as a HP direct blowing-in injector, for example. The entire arrangement is mounted, for example, in the cylinder head 14 of a conventional combustion engine with a reciprocating piston. The pre-chamber can either be designed as a conventional pre-chamber spark plug next to the high-pressure injector or as an annular space around the high-pressure injector. Ideally, the feed channel 34 and/or the overflow openings 32 are arranged in such a way that an at least substantially circular swirl flow arises in the pre-chamber, as illustrated by FIG. 11 by arrows 36 and 46.

One or several ignition sources can be installed in the pre-chamber or assigned to the pre-chamber. By way of example, a commercially available spark plug can be used as the ignition source. The electrode gap should be adjusted to the required maximum pressures at an ignition point of 50 to 150 bar, for example. It should be in the range of 0.1 to 0.2 millimeters, analogous to the Paschen curve for realistic ignition voltages of 30 to 50 kilovolts. The spark plug can either be permanently integrated or it can be replaced in the pre-chamber for a possible replacement due to wear. Furthermore, the center electrode of the spark plug can also be arranged so that the spark gap is created between the pre-chamber wall and the center electrode, see EP 1 476 926 A1.

If capillaries are used to introduce the fuel into the pre-chamber, they may open into the pre-chamber at one or more points to ensure a homogenous mixture of fuel and air. The use of small diameter capillaries for introducing the fuel into the pre-chamber offers the advantage that the metering valves are subjected to only a low temperature load and, due to the long gas flow times, only a low pressure load from the main combustion chamber, see EP 1 936 143 B1. By arranging the capillaries accordingly, a flow can be generated when the fuel is introduced into the pre-chamber at a later stage, which supports the mixing with air.

The number and orientation of the injection openings 24, for example designed as outlet bores, of the injector 20 arise from the requirements for the main diffusion combustion. The number and position or orientation of the overflow opening 32, also referred to as overflow bores, is determined by the following requirements, for example: swirl generation of the pre-chamber; optimum ignition of the high-pressure gas injection jets. The number of overflow bores should correspond to the number of outlet bores. The overflow bores should be arranged in such a way that the high-pressure blowing-in or injecting jets overlap around the flare jets from the respective overflow bore, whereby the ignition of the high-pressure jets is enabled. This results in several possibilities of arrangement, which can be seen, for example, in FIGS. 6 to 8.

With the method described, the advantages of diffusion combustion mentioned above can be used in a similar way to those of a diesel engine, such as, above all, a high degree of efficiency, even for filets that are not or only poorly self-igniting. These can be liquid fuels such as petrol or gaseous fuels such as natural gas. The method makes it possible to dispense with the introduction of ignition jets from a second fuel that is self-igniting under engine conditions. On the one hand, this makes the high-pressure direct blowing-in injector (injector 20) much simpler than known two-component injectors such as needle-in-needle injectors, as described, for example, in WO 2012/171119 A1. On the other hand, the second, additional supply of a self-igniting fuel such as diesel can be completely dispensed with. The tank system, high-pressure pump and fuel lines can be saved for an additional fuel. The exclusive use of gaseous fuels also reduces the tendency to coking. With HP gas injection and the use of cooled, liquified natural gas such as LNG, for example, the concepts known until now result in cut-off and leakage quantities of gas during load changes or necessary changes in gas pressure, which have to be expensively compressed back to high pressure or blown into the intake manifold at low pressure. The LP injection into the pre-chamber offers a simple possibility to utilize these gas quantities within the engine.

Compared to the ignition of the HP direct injection jets by means of glow plugs, as described, for example, in WO 2007/128101, the present method offers the advantage that an ignition source or a flare jet can be assigned to each jet. It is not necessary to install several glow plugs in the cylinder head 14. In addition, the degree of freedom as to when the ignition takes place in the pre-chamber relative to the start of the HP direct blowing-in means that the ignition of HP direct injection can be better controlled with the jets. In addition, commercially available ignition systems are designed for ignition in every combustion cycle, whereas glow plugs are usually only designed for cold start operation and not for continuous operation. By mixing the fuel with the air entering the pre-chamber from the combustion chamber 12, a fuel-air mixture, comprising inert gas if necessary, is produced in the pre-chamber as a mixture which is as homogenous and ignitable as possible, which is spark ignited by means of the spark ignition device 33. After spark ignition of the fuel-air mixture, a pre-mixed or deflagrative flame propagation takes place with a temperature and pressure increase in the pre-chamber. As a result, a flame passes into the combustion chamber 12 via the overflow openings 32 as the aforementioned flare jets, and ignites the fuel gas now blown directly into the combustion chamber 12 by means of the injector or its high-pressure fuel gas jets 28, such that no self-ignition of the fuel gas injected directly into the combustion chamber 12 occurs. The main heat release occurs analogously to the well-known diesel direct injection high-pressure method as diffusive combustion of the fuel gas with a high degree of thermodynamic efficiency. Preferably, the pre-chamber fuel quantity of the fuel introduced into the pre-chamber is significantly smaller than the combustion chamber fuel gas quantity of the fuel gas directly introduced into the combustion chamber 12, wherein, for example, the pre-chamber fuel quantity of the fuel introduced into the pre-chamber is less than 10 percent of the combustion chamber fuel gas quantity of the fuel gas directly blown into the combustion chamber 12. The main heat release and released work of the internal combustion engine result from diffusion combustion of the combustion chamber fuel gas quantity. The pressure levels of both the fuel blown or injected directly into the pre-chamber and the fuel blown or injected directly into the main combustion chamber can be the same. Preferably, due to the working principle, the pressure of the fuel for the pre-chamber may be significantly lower, in particular at low pressure level (LP). Preferably, the introduction, in particular the blowing-in, of the fuel into the pre-chamber (pre-combustion chamber 30) occurs in a range from −360 degrees crank angle up to and including 0 degrees crank angle before the top dead center. The same fuel gases are preferably used for direct blowing-in into the combustion chamber 12 and for the introduction of the fuel into the pre-chamber. In principle, it is also possible to use two different fuels. After filling the pre-chamber with fuel, an overflow at least of air, in particular an air-inert gas mixture, takes place from the main combustion chamber into the pre-chamber, such that the air flowing from the combustion chamber 12 via the overflow openings 32 into the pre-chamber 30 or the aforementioned air-inert gas mixture mixes with the fuel introduced into the pre-chamber 30.

By means of a corresponding arrangement of the fuel supply into the pre-chamber, a flow can be generated in the pre-chamber at high pressure when the fuel is introduced into the pre-chamber later on, which supports the mixing of the fuel with the air. The pre-chamber fuel quantity supplied to the pre-chamber is adjusted in such a way that at ignition time, an ignitable, optimally stoichiometric fuel-air mixture is produced in the pre-chamber by mixing the substance flows at ignition time. This results in a spark ignition of the ideally stoichiometric fuel-air mixture in the pre-chamber. The ignition source can be a conventional spark plug, a spark plug with a spark gap between bracket and chamber wall, a corona ignition, a laser ignition or a microwave ignition. After ignition, a pre-mixed or deflagrative combustion takes place, whereby pressure and temperature increase in the pre-chamber and the burning flare jets spread via the overflow openings 32 into the main combustion chamber with high outlet velocity and turbulence generation. The combustion chamber fuel gas is introduced into the combustion chamber by high-pressure direct blowing-in, as in the case of a high-pressure diesel injector, in a range of from −60 degrees crank angle to +60 degrees crank angle, preferably near the top dead center. Before the combustion chamber fuel gas quantity is introduced into the main combustion chamber (combustion chamber 12), at least air, in particular an air-inert gas mixture, is present in the main combustion chamber.

The arrangement of the overflow openings 32, which are, for example, designed as overflow bores, is preferably such that the emerging flare jets and the high-pressure fuel gas jets 28, which are designed as high-pressure direct blowing-in or injecting jets, intersect geometrically such that the ignition of the latter can take place effectively. The ignition time in the pre-chamber is preferably selected in such a way that the flare jets from the pre-chamber pass over in a range of 60 degrees crank angle before to 60 degrees crank angle after the start of the introduction of the combustion chamber fuel gas quantity into the main combustion chamber. In this way, a reliable ignition of the high-pressure fuel gas jets 28 can be achieved. No homogenous mixing of the high-pressure fuel gas jets 28 with the air or with the air-inert gas mixture in the main combustion chamber is intended. Furthermore, the combustion chamber fuel gas quantity introduced into the combustion chamber 12 in the form of the high-pressure fuel gas jets 28 is spark ignited by the flare jets emerging from the pre-chamber, which are also referred to as flame flare jets. A self-ignition of the combustion chamber fuel gas quantity or of the fuel gas-air mixture in the main combustion chamber is not intended.

The combustion chamber fuel gas quantity or the fuel gas can be introduced separately into the combustion chamber 12 in several blowing-in or injecting processes. In the case of such a subdivided introduction, a first smaller pilot fuel gas quantity can preferably be introduced, which is ignited by the flare jets from the pre-chamber. This results in enlarged flame zones for reliable ignition of the remaining combustion chamber fuel gas quantity, such that, for example, an at least three-stage ignition can be implemented. By dividing the introduction of the fuel gas into the combustion chamber 12 preferably with a pilot fuel gas quantity, the spark ignition of the fuel-air mixture in the pre-chamber can be set to early and thus to a lower pressure, thus improving the conditions for the functioning of a spark ignition system. By way of example, the occurrence of a spark breakthrough during coil ignition is pressure-dependent. Analogous to this engine process, the main combustion takes place as diffusion combustion of the blown-in or injected fuel gas. A fuel is provided as the combustion chamber fuel gas, wherein preferably gaseous fuels such as methane, natural gas (CNG, LNG), LPG, ethane or hydrogen or liquid fuels such as petrol are used as the fuel, whose tendency to self-ignition at engine-relevant pressure-temperature ranges is not sufficient for diesel engine combustion. Preferably, the fuel is identical to the fuel that is fed into the pre-chamber. In principle, different fuels can also be used. The pressure for blowing-in or injecting the fuel into the pre-chambers can be significantly lower than the pressure for blowing-in or injecting the fuel gas into the main combustion chamber. The advantage here is a simpler design and more cost-effective layout of the valve element 38 for the introduction of the fuel into the pre-chamber. For the introduction of the fuel into the pre-chamber, the leakage/control quantity of the HP gas injection or injecting system, for example, can be used if the fuel for the pre-chamber and main combustion chamber is identical. The method can be used for both stationary and mobile applications.

In particular, it is conceivable that, in addition to the injector 20 designed as a high-pressure injector, the pre-chamber can also be provided twice or several times. In particular, the pre-chamber can be designed as an assembly which comprises a flange, the pre-chamber, capillary, the valve element 38, the spark ignition device 33 and the overflow openings 32. In other words, for example, the structural unit 40 comprises the pre-combustion chamber 30, the overflow openings 32, the spark ignition device 33, the feed channel 34, which is provided if necessary, and the valve element 38, for example. The structural unit 40, also referred to as assembly, can for example be pressed into the cylinder head 14 and/or reversibly detachably connected to the cylinder head 14, wherein the structural unit 40 can, for example, be screwed to the cylinder head 14. It is also possible to mount the structural unit 40 by pressing it on the cylinder head 14 or by using a pressing device.

It is also conceivable to integrate the pre-chamber, its volume and the overflow openings 32 directly into the cylinder head 14 optionally by means of constructive design. Preferably, one or more ignition sources are assigned to the pre-chamber, which are located in the pre-chamber, for example. Such an ignition source can be a conventional spark plug, a spark plug with a spark gap between bracket-chamber wall, an HF corona ignition, a laser or microwave ignition. The spark ignition device can be mounted either horizontally or vertically in the pre-chamber. Preferably, the fuel is introduced or fed into the pre-chamber by means of thin and long capillaries and/or by means of an externally arranged valve such as the valve element 38. The valve element 38 is protected against hot fuel gas and combustion chamber pressure by the capillary. Optionally, it is conceivable to feed the fuel into the pre-chamber at least substantially directly via a metering valve. In particular, a tangential and/or other feed of the fuel into the pre-chamber can be provided in such a way that, in particular when the filet is introduced late into the pre-chamber, a flow is generated in the pre-chamber, wherein the flow supports the mixing with the air introduced into the pre-chamber in particular via the overflow opening 32. Optionally, a tangential arrangement of the overflow openings 32 and/or the feed channel 34 is provided in order to generate a swirl in the pre-chamber, by means of which the fuel introduced into the pre-chamber can be mixed particularly well with the air introduced into the pre-chamber. Preferably, the overflow openings 32 are arranged in such a way that the flare jets and the high-pressure fuel gas jets 28 intersect and the latter can be ignited. Preferably, each injection opening 24 or each high-pressure fuel gas jet 28 is assigned, in particular exactly, one overflow opening 32. The respective central axes of the overflow openings 32 and of the feed channel 34 or the feed channels may intersect, be tangential or be arranged opposite one another in order to achieve a particularly advantageous mixing of the air with the fuel and a particularly advantageous mixture homogenization in the pre-chamber.

Substance flows entering the pre-chamber are, for example:

- exclusively air or an air-inert gas mixture from the main combustion chamber, wherein the air-inert gas mixture comprises inert gas, which can, for example, be internally and/or externally recirculated exhaust gas,
- fuel and, where appropriate, air in the case of residual gas content, for example, recirculated exhaust gas in the main combustion chamber or for rinsing.

When operating with liquid gas, which may be stored in a pressure tank, for example, liquid direct injection into the combustion chamber 12 is possible. Rinsing the pre-chamber can be carried out under lower pressure with the gaseous fuel gas present in the tank, wherein, for example, a pressure equalization unit between the gas and liquid phase is provided in the pressure tank. The method can also be used at lower compression ratios of the internal combustion engine, since the initial ignition initiation is carried out by a spark ignition device and is not normally dependent on a chemical self-ignition of one of the fuels used. Furthermore, an optional spark ignition operation of the internal combustion engine can be provided.

In addition to the diffusive combustion mode of the main high-pressure fuel gas jets, the present feed and ignition device allows a changeover to a petrol-engine operation in order to meet possible demanding noise and emission regulations. In addition, this petrol-engine operating mode offers an option in the event that the fuel supply to the pre-chamber fails:

- Fuel injections by means of an existing high-pressure direct injection valve during the expansion/compression stroke, either to produce a fuel-air mixture that is as homogenous as possible in the combustion chamber 12 or a coated fuel-air mixture in the combustion chamber 12. The mixture composition in the main combustion chamber can be stoichiometric with or without residual gas or recirculated exhaust gas or lean with excess air.
- To avoid knocking combustion, the compression ratio may be reduced overall.
- To avoid knocking combustion, a fuel-air mixture diluted by residual gas, recirculated exhaust gas or increased air content can be used.
- For purely petrol-engine operation, the fuel gas injection of the combustion chamber fuel gas volume can be carried out at a significantly reduced pressure level. This also offers the option of using fuel that is available at low pressure.
- Spark ignition as in conventional petrol engine by means of the pre-chamber ignition device.
- The pre-chamber can be rinsed with air and/or fuel to improve ignition.
- After ignition in the pre-chamber, an emission of the flare jets and an ignition of the pre-mixed mixture occurs in the main combustion chamber, whereby a two-stage ignition is representable.
- Deflagrative/pre-mixed combustion in the main combustion chamber, as opposed to a diffusion combustion.

In a first step S1 of the diffusive combustion mode illustrated in FIG. 2, a gas injection, in particular a low-pressure gas injection, takes place into the pre-combustion chamber, whereby the fuel is introduced into the pre-combustion chamber 30, in particular blown in directly. In a second step S2, air flows from the combustion chamber 12 via the overflow openings 32 into the pre-combustion chamber 30, whereby an at least substantially stoichiometric fuel-air mixture is formed in the pre-combustion chamber 30. In a third step S3, a spark ignition and thus an external ignition of the fuel-air mixture in the pre-combustion chamber 30 takes place, resulting in a deflagrative flame propagation. In a fourth step S4, an increase in pressure in the combustion chamber resulting from deflagrative flame propagation occurs, whereby, for example, at least one flame resulting from the ignition of the fuel-air mixture in the pre-combustion chamber flows out of the pre-combustion chamber 30 and into the main combustion chamber via the overflow openings 32, forming the flare jets designated 64 in FIG. 2. In the fourth step S4, the flare jets 64 are transferred into the main combustion chamber. In a fifth step S5, the fuel gas is injected directly into the main combustion chamber within the framework of high-pressure blowing-in, wherein the fuel gas is blown into the combustion chamber 12 by means of the injector 20, forming the high-pressure fuel gas jets 28. The high-pressure fuel gas jets 28 ignite at the flare jets 64, whereby a main combustion takes place as diffusion combustion of a fuel gas-air mixture received in combustion chamber 12, which is provided for in a sixth step S6.

FIG. 5 shows, like FIG. 1, the first embodiment of the gas engine 10, in particular the feed and ignition device 18. In the first embodiment shown in FIG. 1 and FIG. 5, the pre-combustion chamber 30, designed as an annular space or annular chamber, and the overflow openings 32 are formed by a pre-combustion chamber unit as complete assembly, wherein the pre-combustion chamber unit is a component designed separately or independently of the cylinder head 14 and arranged, for example, on the cylinder head 14, in particular arranged in the cylinder head 14. This pre-chamber unit is thus an exchangeable assembly which is reversibly detachably arranged on the cylinder head 14 and can be exchanged, for example, for another pre-chamber unit.

Figure 4:
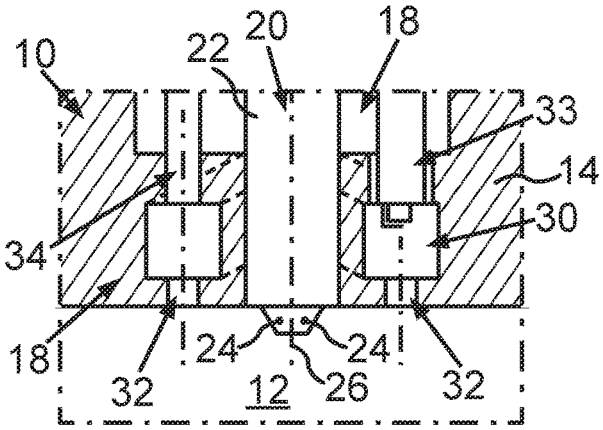
FIG. 4 shows sectionally, a further schematic sectional view of the feed and ignition device according to a second embodiment.

FIG. 4 shows a second embodiment, in which the pre-combustion chamber 30 and preferably the overflow openings 32 are integrated into the cylinder head 14, in particular infused into the cylinder head 14. Here, the respective components are assembled individually.

Figure 6:
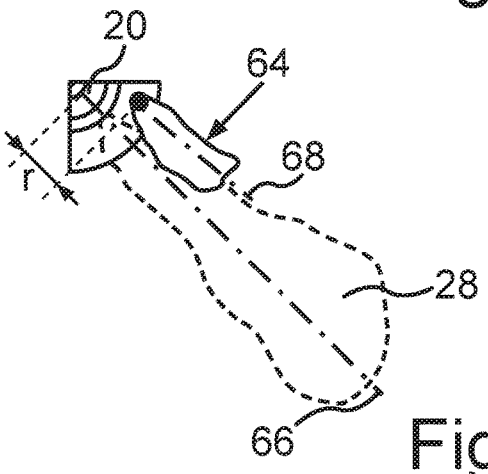
FIG. 6 shows sectionally, a schematic and sectional plan view of the feed and ignition device according to a third embodiment.
Figure 8:
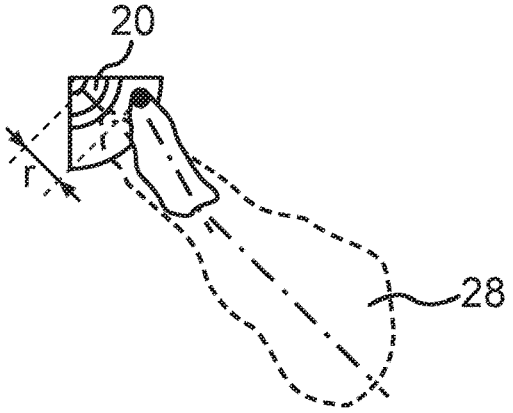
FIG. 8 shows sectionally, a schematic and sectional plan view of the feed and ignition device in accordance with a fifth embodiment.

FIG. 6 shows a third embodiment. In FIG. 6, an axis 66 of one of the high-pressure fuel gas jets 28, designed as a longitudinal central axis, is shown. Furthermore, FIG. 6 shows an axis 68 of one of the flare jets 64, designed as a longitudinal central axis. In the third embodiment shown in FIG. 6, the overflow openings 32 are arranged relative to the injection openings 24 in such a way that the axes 66 and 68 are offset to each other in the peripheral direction of the injector 20 and run parallel to each other. In a fourth embodiment illustrated in FIG. 7, the overflow openings 32 and the injection openings 24 are arranged at the same height in the peripheral direction of the injector 20 or in section at the point of intersection of both jet axes in such a way that the axes 66 and 68 run parallel to one another and are not offset to one another in the direction of rotation of the injector 20. Here, for example, the axes 66 and 68 lie in a common plane in which the axis 26 of the injector 20 also lies.

in a fifth embodiment illustrated in FIG. 8, for example, the overflow openings 32 are offset in the peripheral direction of the injector 20 in relation to the injection openings 24. Alternatively or additionally, it is provided that the axes 66 and 68 intersect or that the respective planes in which the axes 66 and 68 are arranged, run at an angle to each other and intersect each other.

Figure 7:
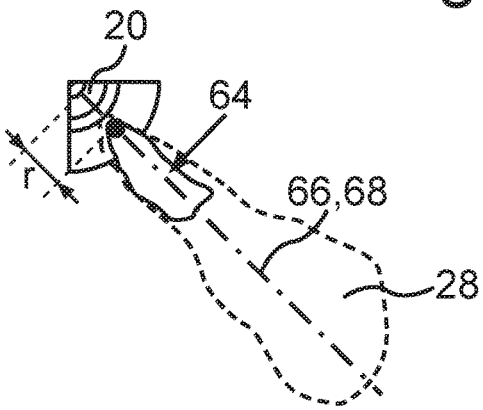
FIG. 7 shows sectionally, a schematic and sectional plan view of the feed and ignition device according to a fourth embodiment.

The respective embodiment is based on the knowledge that the outlet position of the overflow openings 32 influences the ignition of the respective high-pressure fuel gas jet 28, also referred to as gas-jet. The respective flare jet 64 or the respective overflow opening 32 is preferably assigned exactly one injection opening 24 and thus exactly one high-pressure fuel gas jet 28 or vice versa. Here, for example—as illustrated in FIG. 7—the respective high-pressure fuel gas jet 28 and the respectively assigned flare jet 64 have identical axes 66 and 68 in projection from above. Furthermore, it is conceivable that the outlet of the respective high-pressure fuel gas jet 28 and the respective associated flare jet 64 are not axially identical but are slightly intersecting from above at an angle up to right angles. Furthermore, preferably a radial distance r is provided between the outlet of the respective flare jet 64 and the outlet of the respectively associated high-pressure fuel gas jet 28, since, for example, the burning flare jet 64 cannot bridge the complete path from the injector 20 to a so-called air-entrainment zone of a high-pressure fuel gas jet 28 without being blown out by the high-pressure fuel gas jet 28. The high-pressure fuel gas jets 28 have substantially fat jet regions at a short distance from the injection openings 24 of the injector 20, especially directly after leaving the injector 20. In these fat jet regions, there is not yet sufficient mixing of the fuel gas of the fuel gas jets 28 with the combustion air in combustion chamber 12, such that there is no mixture ignitable by the flare jets 64. The fuel gas jets 28 cool down and extinguish in the region of the overflow openings 32 of the flare jets 64. Only at a certain distance r has the fuel gas jet 28 sufficiently mixed with the combustion air in the air-entrainment zone so that the fuel gas-air mixture formed in the air-entrainment zone is ignitable by the flare jets 64. By means of a radial distance r between the respective overflow opening 32 and the respectively assigned injection opening 24, an ignition of the respective high-pressure fuel gas jet 28 can take place via the respectively assigned, burning flare jet in a so-called air-entrainment region of the HP gas jet.

The arrangement of the overflow openings 32 also influences the mixture formation in the pre-chamber, such that preferably the axis is slightly tilted in order to generate a swirl in the pre-chamber. Furthermore, the respective overflow opening 32 preferably has a particularly short length of less than 5 millimeters in order to implement an advantageous impulse of the gas exchange with the main combustion chamber, a blowing out of residual gas from the pre-chamber as well as an entry of air from the combustion chamber for mixture formation. Furthermore, preferably short gas flow paths are provided for the injector 20, wherein a conventional magnetic injector can be used, and wherein a differential pressure control can be avoided. Preferably, an advantageous design of the injection openings 24, which are also designed as gas bores, is achieved without being influenced by pre-chamber channels; lower heat load on the injector 20, since it is further away from the pre-chamber. With a HP gas injector, a certain amount of fuel gas at low pressure is produced when the operating point changes, which cannot be stored in the vehicle tank system. In addition, in the LNG tank system, the liquid natural gas vaporizes in a gaseous manner at low pressure and can no longer be used, which is also used as boil-off gas. This fuel gas at low pressure can be used for combustion in the pre-chamber. In other words, for example, the control quantity and leakage flows are used as fuel gas for the pre-chamber. Furthermore, capillaries with a particularly simple valve can be used to introduce the fuel into the pre-chamber.

The fuel gas or the combustion chamber fuel gas quantity can be fed separately into the combustion chamber 12 by means of several injection processes. In the case of subdivided injection, it is preferable to first inject the small pilot fuel gas quantity which ignites at the flare jets 64 from the pre-chamber. This results in enlarged flame zones for a safe ignition of the remaining main fuel gas quantity, whereby a three-stage ignition is possible. Furthermore, a two-stage ignition is possible, wherein the flare jets 64 from the antechamber directly ignite the high-pressure fuel gas jets 28 which are designed as a combustion chamber fuel gas quantity. Preferably, the flare jets 64 are discharged only shortly before and/or during the injection of the fuel gas into combustion chamber 12, since a direct ignition and no mixing with the jet is provided. By way of example, an upstream filling of the pre-chamber with gas takes place, wherein air is then introduced into the pre-chamber to produce the aforementioned fuel-air mixture. Furthermore, a simultaneous or delayed ignition or multiple ignition may be possible in order to achieve safe inflammation. A combination or the changeover between two operating modes can also be provided, as outlined above. Advantages are a high power density as well as a CO2 emission reduction potential by means of a high thermodynamic efficiency. In addition, the injector 20, which is designed as an HP gas injector, can be used for early gas injection and mixture formation in the compression phase, such as in a direct-injection petrol engine, layered or homogenous fuel gas-air mixture at ignition point, ignition with pre-chamber. Advantages are: no high-pressure gas necessary, low noise emissions, potential for hybridization, lean operation with high efficiency conceivable, high diesel-like compression possible. Another advantage is that a non-chemical spark ignition is provided in the method, such that the method can also be used at low compression ratios (ε).

Figure 9:
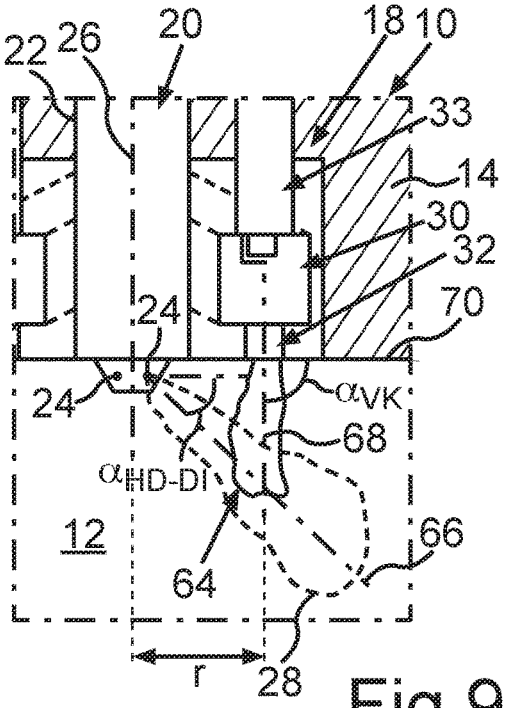
FIG. 9 shows sectionally, a schematic sectional view of the feed and ignition device according to a sixth embodiment.

FIG. 9 shows a sixth embodiment, in which, for example, the axis 68 of the flare jet 64 encloses an angle αVK with an imaginary plane 70, which is at least substantially perpendicular to the axis 26. By way of example, the angle αVK is at least substantially 90 degrees. The axis 66 of the high-pressure fuel gas jet 28 includes an angle αHD-DI with the plane 70, wherein the angles αVK and αHD-DI are different from each other. In particular, the angle αHD-DI is smaller than the angle αVK.

Figure 10:
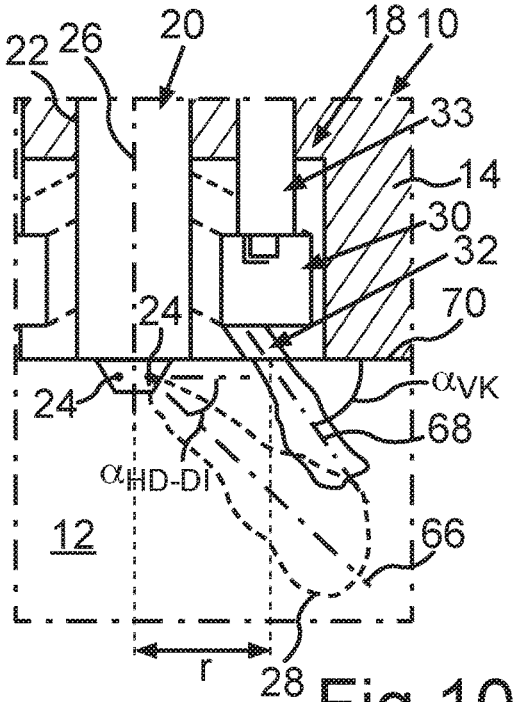
FIG. 10 shows sectionally, a schematic sectional view of the feed and ignition device according to a seventh embodiment.

FIG. 10 shows a seventh embodiment in which both angles αVK and αHD-DI are different from 90 degrees. Furthermore, the angle αHD-DI is smaller than the angle αVK Finally, FIG. 11 shows an eighth embodiment in which the above-mentioned effect of the at least substantially swirling flow is provided in the pre-combustion chamber 30.

The invention claimed is:

1. A feed and ignition device for a gas engine, comprising:

an injector for directly blowing a fuel gas into a combustion chamber of the gas engine;

a pre-combustion chamber into which a fuel is introducible;

a plurality of overflow openings distributed over a periphery of the feed and ignition device in a peripheral direction of the injector via which the pre-combustion chamber is directly connected fluidically to the combustion chamber; and a spark ignition device for igniting a fuel-air mixture comprising at least the fuel introducible in the pre-combustion chamber;

wherein the pre-combustion chamber, the plurality of overflow openings, and the spark ignition device are formed by a first structural unit;

wherein the injector is formed by a second structural unit that is formed separately from the first structural unit; and wherein a longitudinal region of the injector is surrounded by the pre-combustion chamber.

2. The feed and ignition device according to claim 1, wherein the pre-combustion chamber is an annular chamber which is completely closed in the peripheral direction of the injector and surrounds the longitudinal region of the injector completely peripherally.

3. The feed and ignition device according to claim 1, wherein the feed and ignition device causes a swirling flow of the fuel-air mixture in the pre-combustion chamber.

4. The feed and ignition device according to claim 1, wherein a respective injection opening of the injector is assigned to each of the plurality of overflow openings, wherein the injection openings are arranged successively in the peripheral direction of the injector, and wherein the fuel gas is blowable directly into the combustion chamber via the injection openings.

5. The feed and ignition device according to claim 4, wherein a respective overflow opening and injection opening are arranged in the peripheral direction of the injector at a same height and/or at an intersection of two intersecting axes of the overflow opening and the injection opening.

6. The feed and ignition device according to claim 1, wherein the first structural unit has a cylinder head of the gas engine and wherein the pre-combustion chamber is formed by the cylinder head.

7. The feed and ignition device according to claim 1 further comprising a heating element, wherein the heating element heats the pre-combustion chamber.

8. The feed and ignition device according to claim 4, wherein a radial distance is disposed between a respective injection opening and overflow opening.

9. A method for operating the feed and ignition device according to claim 1, comprising the steps of:

igniting a fuel-air mixture present in the pre-combustion chamber by the spark ignition device such that the ignited fuel-air mixture penetrates as flare jets into the combustion chamber via the plurality of overflow openings; and injecting a combustion chamber fuel gas quantity into the combustion chamber by the injector as high-pressure fuel gas jets and igniting the high-pressure fuel gas jets by the flare jets.

10. The method according to claim 9, wherein the combustion chamber fuel gas quantity is divided into a pilot fuel gas quantity and a main fuel gas quantity, wherein the pilot fuel gas quantity is injected into the combustion chamber by the injector, wherein the pilot fuel gas quantity is ignited by the flare jets, and wherein the main fuel gas quantity is ignited by the ignited pilot fuel gas quantity.

11. The method according to claim 10, wherein the pilot fuel gas quantity is smaller than the main fuel gas quantity.

12. The method according to claim 10, wherein the main fuel gas quantity is injected in a plurality of portions.

13. The method according to claim 10, wherein the flare jets penetrate into the combustion chamber shortly before the pilot fuel gas quantity or the combustion chamber fuel gas quantity is injected.

14. The method according to claim 10, wherein the flare jets penetrate into the combustion chamber during the injecting of the pilot fuel gas quantity or the combustion chamber fuel gas quantity.

15. The method according to claim 9, wherein the spark ignition device ignites a plurality of times.

16. The method according to claim 9, wherein a plurality of spark ignition devices are actuated simultaneously or with a time delay.

* * * * *